US006004200A

United States Patent [19]

Ebenhoch et al.

[11] Patent Number: 6,004,200

[45] Date of Patent: Dec. 21, 1999

[54] COIN BAG SPOUT ASSEMBLY

[75] Inventors: Kenneth G. Ebenhoch, Mukwonago; Joseph P. Hanus, Johnson Creek, both of Wis.

[73] Assignee: Brandt, Inc., Watertown, Wis.

[21] Appl. No.: 08/980,701

[22] Filed: Dec. 1, 1997

[51] Int. Cl.[6] ..... G07D 9/00; B65B 67/04

[52] U.S. Cl. ..... 453/63; 248/99

[58] Field of Search ..... 453/31, 63; 248/95, 248/99

[56] References Cited

U.S. PATENT DOCUMENTS

| | | | |
|---|---|---|---|
| 5,295,899 | 3/1994 | Adams et al. | 453/10 |
| 5,297,598 | 3/1994 | Rasmussen | 141/314 |
| 5,443,419 | 8/1995 | Adams et al. | 453/17 |
| 5,830,056 | 11/1998 | Adams et al. | 453/63 |
| 5,836,553 | 11/1998 | Bergaila | 248/99 |

FOREIGN PATENT DOCUMENTS

| | | | |
|---|---|---|---|
| 0 157 405 | 10/1985 | European Pat. Off. . | |
| 2 046 694 | 11/1980 | United Kingdom | 248/95 |
| 2 128 795 | 5/1984 | United Kingdom . | |

OTHER PUBLICATIONS

European Patent Office search report on PCT Appln. No. US98/25067, dated Mar. 31, 1999.

*Primary Examiner*—Robert P. Olszewski
*Assistant Examiner*—Bryan Jaketic
*Attorney, Agent, or Firm*—Quarles & Brady LLP

[57] ABSTRACT

A coin bag spout assembly (25) includes a clip member (26) having an open side and a tubular spout member (27) which pivots through the open side of the clip member (26) for easy removal of filled coin bags.

11 Claims, 3 Drawing Sheets

FIG. 5
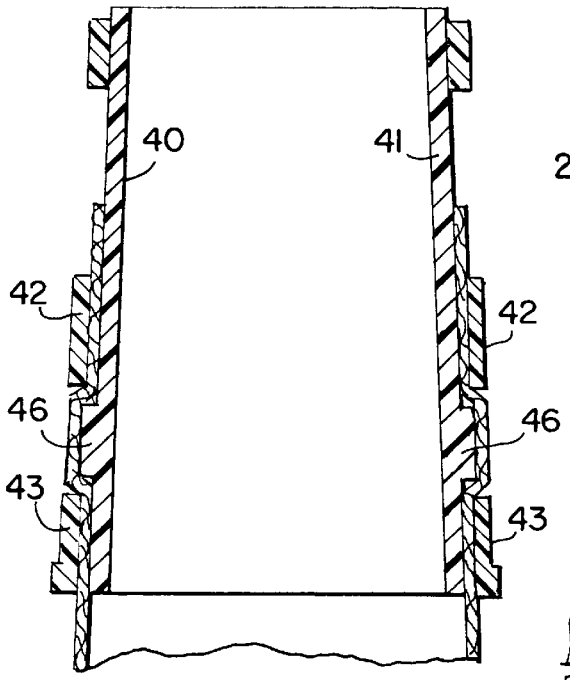
FIG. 8
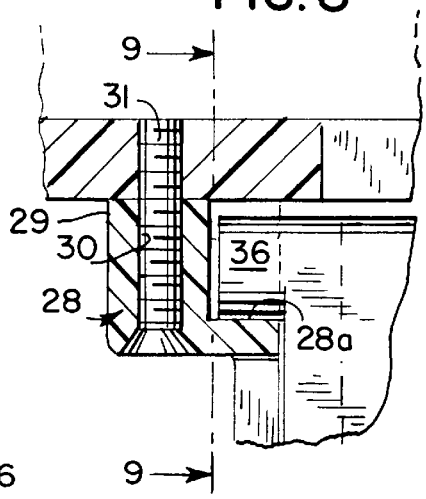
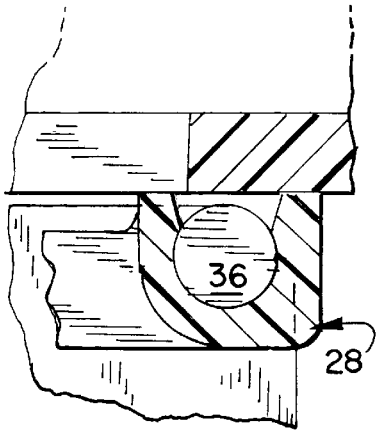
FIG. 9
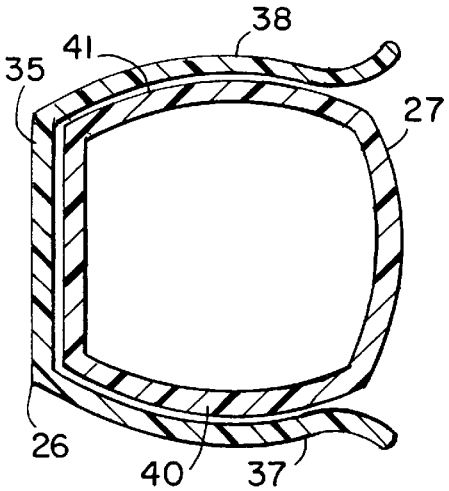
FIG. 6
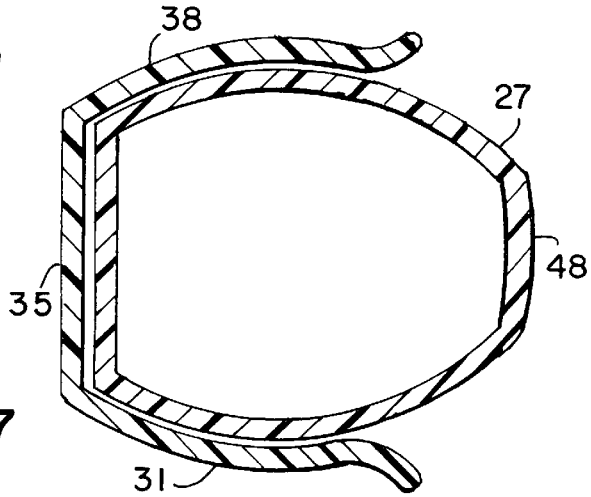
FIG. 7

COIN BAG SPOUT ASSEMBLY

BACKGROUND OF THE INVENTION

This invention relates to coin and token handling machines and particularly to a spout to which a coin bag can be attached for the delivery of coins through the spout into the bag.

Coin handling machines, such as coin sorters or counters, often discharge coins or tokens into a cloth bag. A filled coin bag can be quite heavy. Therefore, it is necessary to provide a positive attachment of the coin bag to the coin discharge point on the coin handling machine.

In the past, bags have been attached to spouts using a metal ring surrounding a cylindrical spout with the bag pinched between the ring and the periphery of the spout. An example of this form of bagging spout is shown in U.S. Pat. No. 5,443,419 issued Aug. 22, 1995 to Adams, et al. for "Collector Assembly for Coin Handling Machine". Another form of bagging attachment that has been used incorporates a spring clamp into which a coin spout is moved linearly. A gathered portion of the coin bag is pinched between the spring clamp and the spout. Such an arrangement is shown in U.S. Pat. No. 5,297,598 issued Mar. 29, 1994, to Rasmussen, et al. for "Coin Bag Holding Device for Coin Handling Machine".

The past mechanisms for attaching the coin bag to the spout have required the operator to use both hands. The bag spout assembly of the present invention is designed to be operated with one hand by an experienced operator.

SUMMARY OF THE INVENTION

In accordance with the invention, a coin bag spout assembly includes a generally U-shaped stationary clip member and a spout member pivotally attached for movement into and out of the open side of the clip member. The clip member is adapted for attachment adjacent to a discharge point on a coin handling machine. The spout member is adapted to be inserted into the open mouth of a coin bag while pivoted out of engagement with the clip member. When the spout member with bag is pivoted into engagement with the clip member, the bag will be gripped between the outside of the spout member and the inner surfaces of the clip member.

Preferably, the sides of the clip member are formed into yieldable fingers. Furthermore, the spout member preferably has bosses which enter into the spaces between fingers on each side of the clip member to enhance the gripping action.

Also in the preferred embodiment, the spout member has a forward extending lip portion adjacent its bottom opening which can be grasped by an operator to pivot the spout member out of engagement with the clip for releasing a coin bag.

An operator can remove and replace a coin bag using only one hand by the simple act of pivoting the spout member out of engagement with the clip member and then re-engaging the spout member with the clip member after a filled bag has been removed and a new bag placed about the spout member.

The foregoing and other objects and advantages of the invention will appear in the detailed description which follows. In the description, reference is made to the accompanying drawings which illustrate a preferred embodiment of the coin spout assembly.

BRIEF DESCRIPTION OF THE DRAWINGS

FIG. 5 is a view in vertical section through the coin spout assembly taken in the plain of the line 5—5 of FIG. 2;

FIG. 6 is a view in horizontal section of the spout assembly taken in the plane of the line 6—6 of FIG. 2;

FIG. 7 is a view in horizontal section of the spout assembly taken in the plane of line 7—7 of FIG. 2;

FIG. 8 is an enlarged view in vertical section taken in the plane of the line 8—8 in FIG. 2; and FIG. 9 is an enlarged view in vertical section taken in the plane of the line 9—9 in FIG. 8.

DETAILED DESCRIPTION OF THE PREFERRED EMBODIMENT

The bagging spout is usable with a variety of coin handling equipment, including coin sorters of the type shown in U.S. Pat. No. 5,295,899 issued Mar. 22, 1994, for "Two Disc Coin Handling Apparatus". In such coin sorters, coins are deposited on the surface of a rotating disc which forms the coins into a single file in a single layer and feeds the aligned coins to a sorting plate in which the coins exit at spaced openings in the plate depending upon their size. Each denomination of coin to be sorted can be discharged into a respected one of a plurality of collectors. The collectors can include spouts which lead to cloth coin bags. U.S. Pat. No. 5,443,419 issued Aug. 22, 1995, for "Collector Assembly for Coin Handling Machine" illustrates various forms of collectors, including drawers and chutes which allow coins to pass through the collector to an opening beneath the collector.

Figure 1:
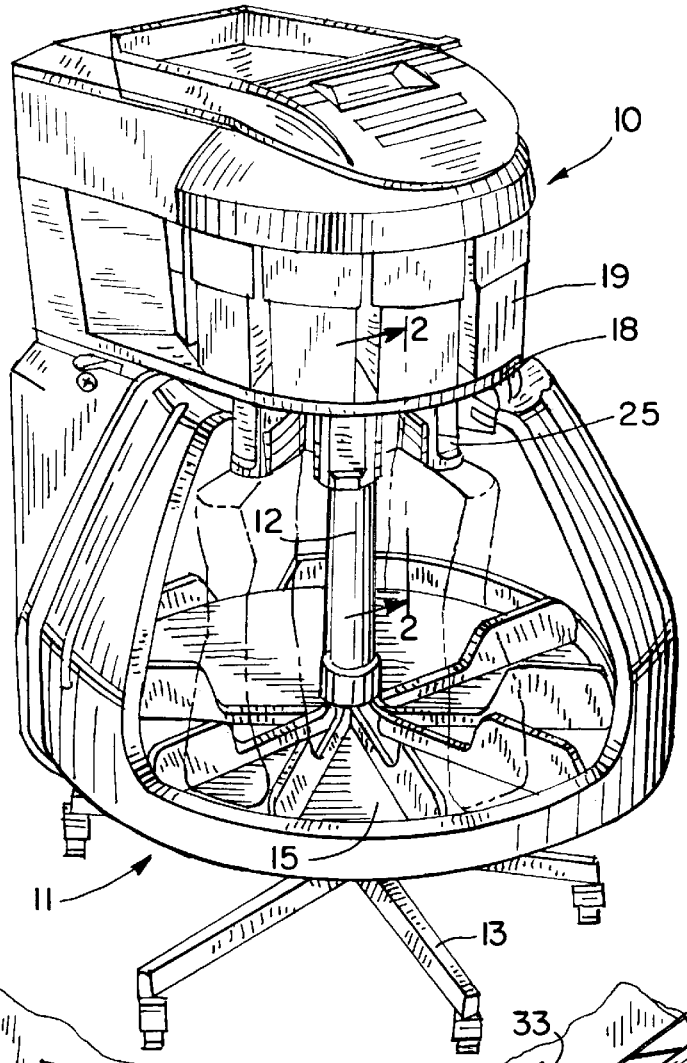
FIG. 1 is a view in perspective of a coin sorting machine using the coin bag spout assemblies of the present invention.
Figure 4:
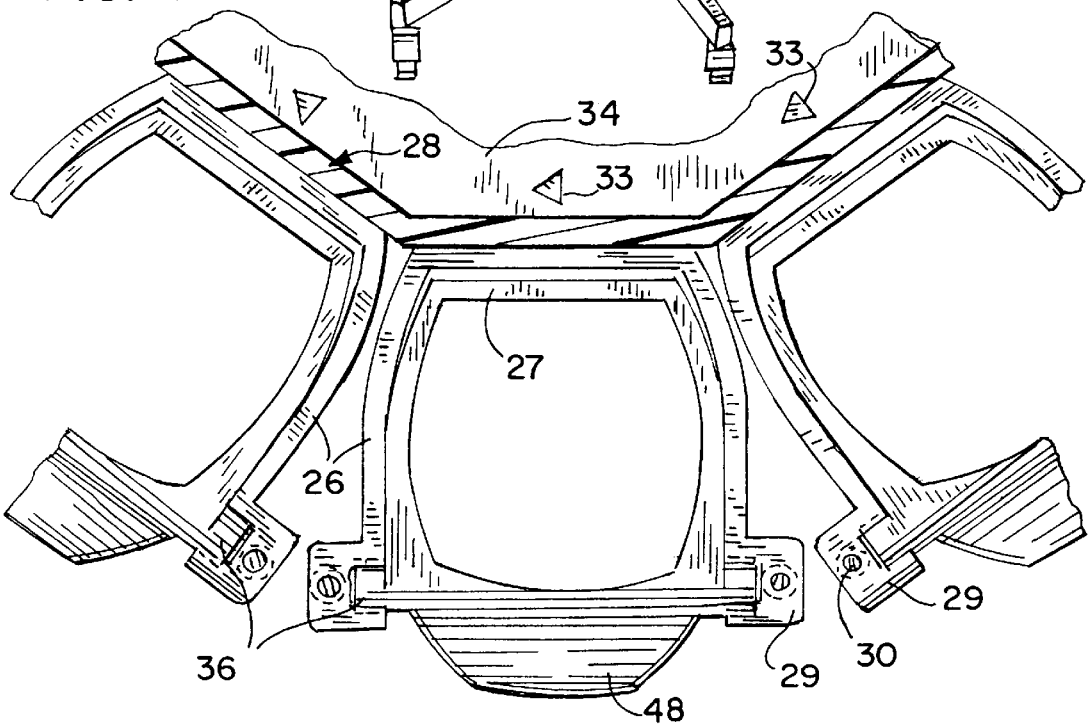
FIG. 4 is a top view of several bag spout assemblies taken in the plane of the line 4—4 of FIG. 2.

FIG. 1 illustrates such a coin sorter 10 mounted on a stand 11 that includes an upright shaft 12 attached to the underside of the coin sorter 10 and a base 13 formed of a plurality of radially extending legs. A circular floor 15 forms a part of the stand 11 to support the weight of coin bags.

The sorter 10 has a bottom plate 18 on which collector chutes 19 rest. The bottom plate 18 contains coin discharge openings 20 aligned with openings in the bottom of the collectors 19. A coin bag spout assembly 25 in accordance with the present invention is mounted beneath each of the openings 20.

The spout assembly 25 includes a stationary clip member 26 and a spout member 27. The clip member 26 has bearing portions 28 extending from each side of its upper top. The bearing portions 28 terminate in lands 29 with openings 30 that receive screws 31 to mount the clip member to the underside of the bottom plate 18. A projection 32 extends from the lower rear of each clip member 26. The projection 32 mounts a triangular boss 33 that is received in a mating opening in the lower flange 34 of a channel shaped member 35 attached to the underside of the bottom plate 18 to thereby locate the clip member 26.

Figure 2:
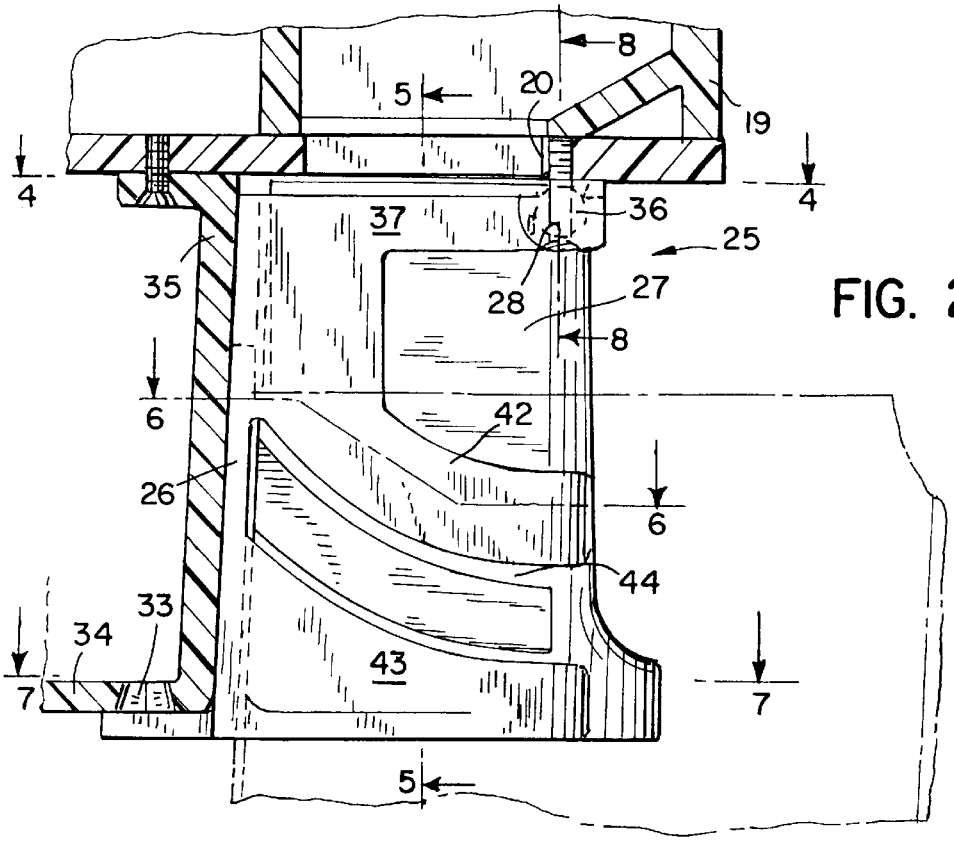
FIG. 2 is a view in side elevation of a bag spout assembly taken in the plane of the line 2—2 of FIG. 1.
Figure 3:
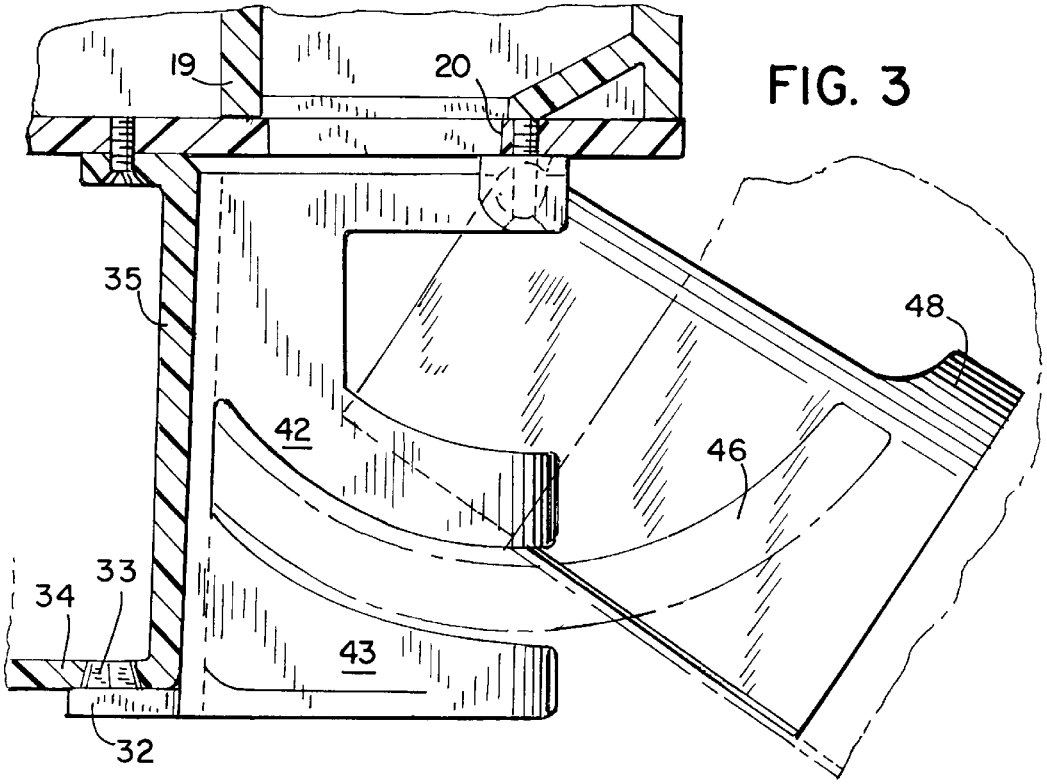
FIG. 3 is a view similar to FIG. 2 but showing the spout member disengaged from the clip member.

The spout member 27 is generally tubular in shape. Its upper front edge mounts a pair of pins 36 which are received in the bearings **28*a* formed by bearing portions 28. As a result, the spout member 27 is capable of being pivoted into and out of engagement with the stationary clip member 26. When the spout member 27 is engaged with the clip member 26, as shown in FIG. 2, the spout member 27 is aligned with the opening 20 in the lower plate 18**.

As shown in FIGS. 6 and 7, the sides 37 and 38 of the clip member 26 extend partially around bulging sides 40 and 41 of the spout member 27. Thus, the sides 37 and 38 of the clip member 26 will be forced apart when the spout member 27 is pivoted into engagement with the clip member 26. To provide a degree of flexibility to the sides 37 and 38 of the clip member 26, the sides are formed into upper and lower fingers 42 and 43 separated by a space 44. The top and bottom edges of the space 44 are defined by radii of the axis of the pivot pins 36 in the bearings 28. The bulging sides 40 and 41 of the spout member 27 are provided with rectangular bosses 46 which are shaped to nearly fill the space 44 between the fingers 42 and 43 when the spout member 27 is engaged with the clip member 26. The bottom of the spout member 27 is provided with a forwardly projecting lip portion 48.

In operation, the spout member 27 is released from engagement with the clip member 26 by the operator grasping the lip portion 48 and pivoting the spout member 27 outwardly. The open mouth of a coin bag can then be slid over the outside of the spout member 27. The spout member 27 will not fill the open mouth of the coin bag. Instead, the operator grasps the loose portion of the coin bag and pivots the spout member 27 rearwardly to engage the clip member 26. The rear of the mouth of the coin bag is pinched between the outer surfaces of the spout member 27 and the inner surfaces of the clip member 26. As shown in FIG. 5, the coin bag is held against vertical loads by the interengagement of the bosses 46 with the fingers 42 and 43 on the sides of the clip member 26.

To remove a filled or partially filled bag from the spout assembly, the operator grasps the top of the bag or the lip portion 48 and pulls it outwardly thereby pivoting the spout assembly 27 free of the clip member 26.

Although the spout member 27 is shown as being pivotally connected to the top of the clip member 26, it could be pivotally attached to a bracket on the underside of the bottom plate 18 separate from the clip member 26.

The bag spout assembly can be used in connection with any form of coin handling machine in which the coins fall through an opening.

We claim:

1. A coin bag spout assembly, comprising:

a U-shaped stationary clip member having a rear wall adapted for attachment adjacent to a coin discharge point and having two spaced apart sides extending forward from the rear wall; and a tubular spout member having one end pivotally mounted about an axis oriented transversely to the spaced apart sides of the clip member and having an opposite end to be pivoted forwardly and outwardly from the open side of the clip member from a secured position between the sides of the clip member.

2. A spout assembly according to claim 1 wherein the sides of the clip member have spaced fingers that engage with the sides of the spout member.

3. A spout assembly according to claim 2 wherein the space between the fingers on each side of the clip member are defined by radii extending from the pivot axis of the spout member.

4. A spout assembly according to claim 3 wherein the spout member has bosses on its outer surface that mate with the spaces between the fingers of the clip member.

5. A spout assembly according to claim 1 wherein the spout member has an outwardly extending lip portion at its opposite end, which is a front lower end.

6. A coin bag spout assembly comprising:

a stationary clip member having spaced fingers extending from a rear wall; and a hollow spout member pivotally attached at an upper end to the clip member for movement into and out of a position secured by the fingers of the clip member.

7. A coin bag spout assembly, comprising:

a stationary clip member adapted for attachment adjacent to a coin discharge point, said clip member having spaced fingers that extend on each side of a central open area; and a tubular spout member having one end mounted to the clip member on a pivot axis that allows the clip member to be pivoted forwardly and upwardly out of a position between the fingers of the clip member.

8. A spout assembly according to claim 7 wherein the space between the fingers on each side of the clip member are defined by radii extending from the pivot axis of the spout member.

9. A spout assembly according to claim 8 wherein the spout member has bosses on its outer surface that mate with the spaces between the fingers of the clip member.

10. A spout assembly according to claim 7, wherein the spout member has an outwardly extending lip portion at its front bottom end for grasping by an operator.

11. A coin bag spout assembly, comprising:

a U-shaped stationary clip member adapted for attachment adjacent to a coin discharge point;

a tubular spout member pivotally mounted about an axis relative to the clip member to be moved through the open side of the clip member into and out of engagement with the sides of the clip member;

wherein the sides of the clip member have spaced fingers that engage with the sides of the spout member; and wherein the space between the fingers on each side of the clip member are defined by radii extending from the pivot axis of the spout member.

* * * * *